US006031461A

United States Patent [19]

Lynn

[11] Patent Number: 6,031,461

[45] Date of Patent: Feb. 29, 2000

[54] METHOD AND APPARATUS FOR HELPING TO ASSURE THE WASHING OF HANDS

[76] Inventor: John M. Lynn, 8616 Mendocino Dr., Austin, Tex. 78735

[21] Appl. No.: 09/170,172

[22] Filed: Oct. 13, 1998

[51] Int. Cl.[7] ..... G08B 23/00

[52] U.S. Cl. ..... 340/573.1; 15/1; 15/244.4; 15/245; 15/255.05; 222/92; 222/175

[58] Field of Search ..... 340/573.1, 540; 428/41.1, 34.1, 40.8, 41.2, 41.6; 4/661, 668, 222; 15/1, 244.4, 245, 255.05; 222/39, 42, 175; 292/347; 422/291, 186; 424/9.71

[56] References Cited

U.S. PATENT DOCUMENTS

| | | | |
|---|---|---|---|
| 1,491,780 | 4/1924 | Abbott | 292/347 |
| 1,783,097 | 11/1930 | Polcari | 292/347 |
| 2,527,955 | 10/1950 | Pagel | 422/291 |
| 3,314,746 | 4/1967 | Millar | 422/186 |
| 4,431,628 | 2/1984 | Gaffar | 424/9.71 |
| 4,832,942 | 5/1989 | Crace | 428/41.1 |
| 5,043,013 | 8/1991 | Kluger et al. | 106/31.32 |
| 5,810,201 | 9/1998 | Besse et al. | 222/39 |
| 5,812,059 | 9/1998 | Shaw et al. | 340/573.1 |
| 5,870,015 | 2/1999 | Hinkel | 340/573.1 |

*Primary Examiner*—Benjamin C. Lee
*Attorney, Agent, or Firm*—Baker & Botts, L.L.P.

[57] ABSTRACT

A method and apparatus are disclosed for helping to assure the washing of hands. An easily identifiable substance is provided which can be removed by washing, and a marking mechanism is coupled to the easily identifiable substance. A hand of a person is then marked with the easily identifiable substance when the marking mechanism is triggered. In one embodiment, a flush mechanism of a toilet or urinal is equipped with the marking mechanism, and the marking mechanism is triggered when a person flushes the toilet or urinal. In another embodiment, a door handle is equipped with the marking mechanism, and the marking mechanism is triggered when a person uses the door handle.

20 Claims, 1 Drawing Sheet

METHOD AND APPARATUS FOR HELPING TO ASSURE THE WASHING OF HANDS

TECHNICAL FIELD OF THE INVENTION

The present invention relates in general to the field of maintaining sanitary areas, to a method and apparatus for helping to assure the washing of hands, and, more particularly, to doing so by marking a person's hands with an easily identifiable substance that requires washing of their hands to remove the substance.

BACKGROUND OF THE INVENTION

In a variety of different fields and businesses, there is a need for assuring that persons who enter certain areas have sanitized their hands prior to entry. Obvious examples include food preparers and health care workers (although there are other potential examples too numerous to list). An example of a specific need for assuring sanitized hands is the restaurant industry. It has been known for many decades that food preparers, servers and so forth should clean and sanitize their hands prior to handling others' food. This need is self-evident after restaurant employees have been in restrooms/toilets. Bacteria (such as *E-coli* and fecal matter) in restrooms/toilets, are well known problems and without proper cleaning/sanitization of the hands of restaurant employees the problem can be transmitted to unknowing customers. There is also a need for sanitized hands in private residences. This is especially true of homes with children. Physicians have known for many years that washing one's hands frequently (and especially after use of the bathroom) is a very important factor in minimizing illness.

In the past, restaurants and parents have tried to address the problem by rules and regulations concerning hand washing. For instance, in many restaurants there are signs which state roughly "Employees must wash their hands before leaving." Obviously, methods which require adherence to a rule or policy by human beings are insufficient to assure foolproof compliance. Thus, there is a strong need for a method of assuring that people have sanitized their hands, and, in particular, have done so before entry is allowed into certain areas.

Presently there are both patented and un-patented systems intended to address this problem. These other systems are either not foolproof (i.e., require individual compliance with rules) or are complex and accordingly prohibitively expensive. U.S. Pat. No. 5,670,945, for example, discloses a complex system that has a sanitizing basin with moisture proof switches inside the sanitizing basin and proximity detectors. A person must insert both hands simultaneously into the sanitizing basin in order to initiate the desired output signal. U.S. Pat. Nos. 5,202,666; 4,896,144; 3,967,478; 5,610,589; 4,688,585 and 5,199,188 all involve complex systems containing such things as electronics, sensors, pumps and so forth. Additionally, none of these systems effectively assure that an unintentional improper sanitizing of a worker's hands will be detected.

There is a need for a foolproof, simple and inexpensive method to assure that persons wash their hands before entering sanitary areas. Especially desirable is a system that is simple and inexpensive enough to allow it to be retrofitted into existing bathrooms in commercial and residential locations.

SUMMARY OF THE INVENTION

In accordance with the present invention, a method and apparatus are disclosed for helping to assure the washing of hands that provide advantages over prior sanitization schemes.

According to one aspect of the present invention, a method for helping to assure washing of hands involves providing an easily identifiable substance which can be removed by washing. A marking mechanism is coupled to the easily identifiable substance, and a hand of a person is then marked with the easily identifiable substance when the marking mechanism is triggered.

According to another aspect of the present invention, an apparatus for helping to assure washing of hands includes an easily identifiable substance which can be removed by washing. A marking mechanism is coupled to the easily identifiable substance, and the marking mechanism is operable to mark a hand of a person with the easily identifiable substance when the marking mechanism is triggered.

In one implementation, a flush mechanism of a toilet or urinal is equipped with the marking mechanism, and the marking mechanism is triggered when a person flushes the toilet or urinal. In another embodiment, a door handle is equipped with the marking mechanism, and the marking mechanism is triggered when a person uses the door handle.

It is a technical advantage of the present invention that it assures individuals wash their hands by marking their hands with an easily identifiable substance.

It is another technical advantage that the present system and method is relatively simple and inexpensive and can be retrofitted into existing commercial and residential restrooms and entrances to existing commercial and residential sanitary areas.

Other technical advantages of the present invention should be apparent from the drawings, specification and claims.

BRIEF DESCRIPTION OF THE DRAWINGS

A more complete and thorough understanding of the present invention and advantages thereof may be acquired by referring to the following description taken in conjunction with the accompanying drawings, in which like reference numbers indicate like features, and wherein.

DETAILED DESCRIPTION OF THE INVENTION

Figure 1:
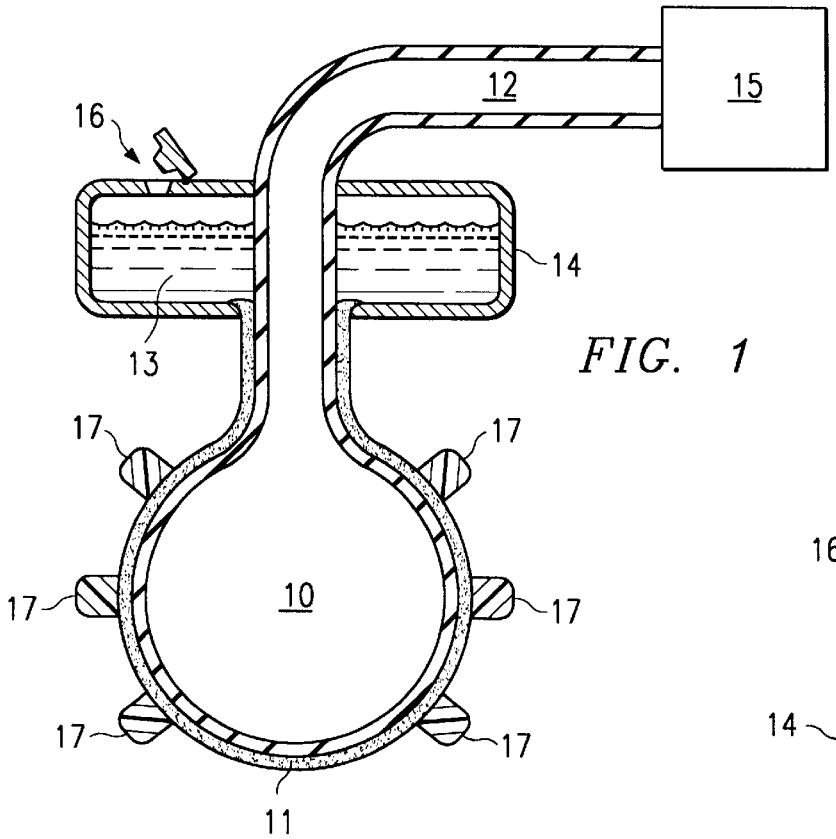
FIG. 1 is a cross-section of one embodiment of a toilet flushing mechanism with a marking mechanism.

FIG. 1 is a cross-section of one embodiment of a toilet flushing system with a marking mechanism. In the embodiment of FIG. 1, the marking mechanism comprises a compressible bulb 10 connected to (or integral with) a pneumatic hose 12. By squeezing bulb 10, this forces air into hose 12 which signal (or event) can be used in a variety of different ways to flush a toilet using flushing mechanism 15. Those skilled in the art should recognize that both the marking mechanism 10 or the flushing mechanism 15 could be any of a large number well known and commercially available mechanisms such as any of the following types of systems: (1) mechanical, (2) pneumatic, (3) pneumatic (mechanical), (4) electronic and (5) any combination thereof. The present invention can provide benefits to any such flushing mechanism, and the specific type of flushing mechanism is relatively unimportant.

In the embodiment of FIG. 1, the marking mechanism operates as a mechanical trigger and further comprises an absorbing material 11 which covers, or is an integral part of, bulb 10. Absorbing material 11 contains or is saturated with an easily identifiable substance 13 which is held in container 14. In one embodiment, container 14, the easily identifiable substance 13 and absorbing material 11 are designed such that absorbing material 11 always contains enough of the easily identifiable substance 13 to mark a person's hands who squeezes bulb 10. One of many methods to assure a steady supply of an easily identifiable substance 13 is to gravity feed the easily identifiable substance 13 to absorbing material 11. Easily identifiable substance 13 can be re-filled into container 14, for example through opening 16.

Easily identifiable substance 13 can be any of a number of substances which are commercially available and well known in the art. Important characteristics of substance 13 are that it clearly marks a person's hands, be non-toxic and be washable with soap and water or some other desirable cleansing or disinfecting solution. Likewise, the easily identifiable substance 13 should not dry out when it is on absorbing material 11. Easily identifiable substance 13 could be, for example, a paint, dye, chalk, stain, ink, grease, pigment or combination thereof which will clearly mark a person's hand(s). In addition to visual markings, there could be invisible markings which show up not to the naked eye, but when exposed to certain mediums such as ultraviolet light.

In this embodiment of the present invention the marking mechanism is manually triggered such that it will mark a person's hands quite thoroughly (e.g., even between the fingers) with an easily identifiable solution 13 and accordingly it forces the person to clean the marked hand (and obviously the other hand as well) even more thoroughly than might normally be done. This thorough cleaning of the hands is an added benefit of the present invention. Further, the thorough marking of the hand with an easily identifiable solution 13 can be optimized by designing the marking mechanism such that the easily identifiable substance 13 is deposited between the fingers. In another embodiment the marking mechanism has finger guides 17 which force a person's fingers apart such that when the person squeezes bulb 10 through absorbing material 11 the easily identifiable substance 13 is deposited between the person's fingers. The finger guides 17 have the added benefit of making it more difficult (or impossible) to bypass the entire system by using a paper towel or cloth to activate the marking mechanism and accordingly not getting an easily identifiable substance 13 on the person's hands. In another embodiment of the invention the marking mechanisms disclosed herein can be used redundantly with a back up electronic detection system to determine if a person has entered a restroom or not. One such electronic system using name tags is disclosed in U.S. Pat. No. 5,610,589.

In general, according to this aspect of the present invention, the flushing mechanism of a toilet (and/or urinal) can be equipped with a marking mechanism that marks a person's hand with an easily identifiable substance when the toilet is flushed. Thus, the person using the toilet must then either not flush the toilet (obviously not an viable alternative) or have their hand marked by the easily identifiable substance. The easily identifiable substance can then be removed only by using soap or other sanitizing agent which also sanitizes the person's hands. Depending on the situation, the easily identifiable substance can be designed to be compatible with an optimum cleaning medium. For example, in a restroom, the easily identifiable substance should be designed to optimize hand cleaning (e.g., both as to duration and effort) with an anti-bacterial soap.

As shown, the marking mechanism can be manually triggered and preferably designed such that in order to flush the toilet the hand doing the flushing is thoroughly marked with the easily identifiable substance. Accordingly it takes a thorough washing of the hand to clean off the easily identifiable substance. The easily identifiable substance is preferably non-toxic, highly visible and not washable with only water but washable quite easily with a thorough hand washing with a sanitizing solution (for example, an antibacterial soap). Clearly, the only practical way to thoroughly wash one hand is to use the other hand also, resulting in two clean and sanitized hands.

Figure 2:
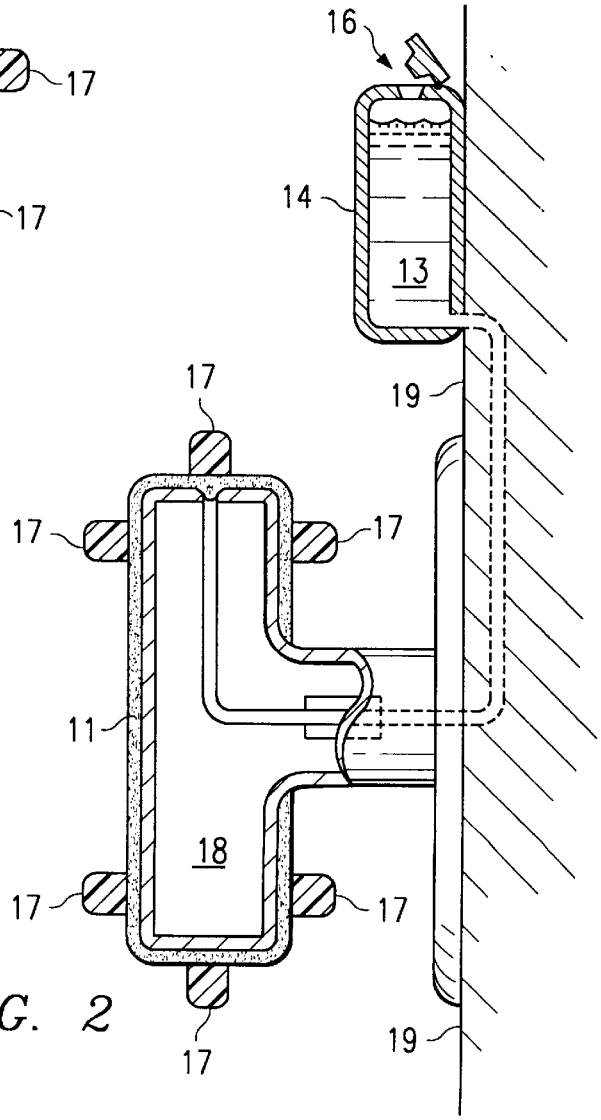
FIG. 2 is a cross-section of one embodiment of a door knob equipped with a marking mechanism.

FIG. 2 is a cross-section of one embodiment of a door knob equipped with a marking mechanism. In this embodiment, the marking mechanism is connected to an entrance door 19 to a sanitary area. A shown in FIG. 2, the absorbing material 11 covers door knob 18 which allows entry to a sanitary area. The container 14 with an easily identifiable substance 13 is positioned above door knob 18 and gravity feeds the easily identifiable substance 13 onto absorbing material 11. If a person who wants to enter the sanitary area must use door knob 18, then their hand will be marked with the easily identifiable substance 13. Similar to the trigger mechanism of FIG. 1, the door knob can also have finger guides 17 to assure thorough marking of the hand and disallow using paper towels or cloth to bypass the system. Again, as with the above embodiment, once the hands are marked, the person must thoroughly clean their hands to remove the easily identifiable substance 13.

In general, according to this additional aspect of the present invention, the entrance to a sanitary area can be equipped with the marking mechanism. An example, as shown in FIG. 2, would be to equip the door knob of the sanitary area with the marking mechanism which is manually triggered. The design would ensure that a person entering must immediately thoroughly wash their hands after entering the sanitary area or alternatively be easily identifiable as not having washed their hands. This embodiment would work well, for example, in areas such as entrances to cooking areas in restaurants, sanitary areas in hospitals and high technology clean rooms. As discussed above, the easily identifiable substance could be chosen to optimize hand cleaning depending on the end use. For example, before entering a high-technology clean room the main goal may to minimize particulates rather than bacterial contamination. Accordingly, the easily identifiable substance may be chalk, pigment or another particulate substance rather than a liquid. This notion of "dirtying" one's hands in order to subsequently get them clean may be counter-intuitive, but it could result in especially clean hands if the easily identifiable substance and the cleaning medium are well chosen.

Although the present invention has been described with respect to a specific preferred embodiment thereof, various changes and modifications may he suggested to one skilled in the art and it is intended that the present invention encompass such changes and modifications fall within the scope of the appended claims.

What is claimed is:

1. A method for helping to assure the washing of hands, comprising:

providing an easily identifiable substance which can be removed by washing;

providing a marking mechanism coupled to the easily identifiable substance and physically connected to an actuating member that is associated with an event that requires washing of hands; and marking a hand of a person with the easily identifiable substance when the marking mechanism is triggered upon the hand operating the actuating member.

2. The method of claim 1, wherein:

providing a marking mechanism comprises equipping a flush mechanism of a toilet or urinal with the marking mechanism; and the marking mechanism is triggered when a person flushes the toilet or urinal.

3. The method of claim 1, wherein:

providing a marking mechanism comprises equipping a door handle with the marking mechanism; and the marking mechanism is triggered when a person uses the door handle.

4. The method of claim 1, wherein:

providing a marking mechanism comprises providing a mechanical trigger; and marking the hand occurs when the mechanical trigger is actuated.

5. The method of claim 4, wherein the mechanical trigger is covered with an absorbent material which contains the easily identifiable substance.

6. The method of claim 4, wherein an absorbent material which contains the easily identifiable substance is formed integral with the mechanical trigger.

7. The method of claim 4, wherein further comprising finger guides are associated with the marking mechanism.

8. The method of claim 4, wherein the mechanical trigger comprises a compressible bulb.

9. The method of claim 1, wherein the easily identifiable substance is selected from the group consisting of paint, dye, pigment, chalk and stain.

10. An apparatus for helping to assure the washing of hands, comprising:

an easily identifiable substance which can be removed by washing; and a marking mechanism coupled to receive the easily identifiable substance, the marking mechanism physically connected with an actuating member that is associated with an event that requires washing of hands, and operable to mark a hand of a person with the easily identifiable substance when the marking mechanism is triggered upon the hand operating the actuating mechanism.

11. The apparatus of claim 10, wherein the actuating member comprises a flush mechanism of a toilet or urinal and to be triggered when a person flushes the toilet or urinal.

12. The apparatus of claim 10, wherein the marking mechanism is formed to be coupled to a door handle which provides a portion of the actuating member and to be triggered when a person uses the door handle.

13. The apparatus of claim 10, wherein the marking mechanism comprises a mechanical trigger operable to mark the hand when the mechanical trigger is actuated.

14. The apparatus of claim 13, further comprising finger guides associated with the marking mechanism.

15. The apparatus of claim 13, further comprising an absorbent material covering the mechanical trigger, the absorbent material containing the easily identifiable substance.

16. The apparatus of claim 15, further comprising a container operable to hold the easily identifiable substance and coupled to provide the easily identifiable substance to the absorbent material.

17. The apparatus of claim 13, wherein the mechanical trigger comprises an absorbent material formed integral therewith, the absorbent material containing the easily identifiable substance.

18. The apparatus of claim 17, further comprising a container operable to hold the easily identifiable substance and coupled to provide the easily identifiable substance to the absorbent material.

19. The apparatus of claim 13, wherein the mechanical trigger comprises a compressible bulb.

20. The apparatus of claim 10, wherein the easily identifiable substance is selected from the group consisting of paint, dye, pigment, chalk and stain.

* * * * *